US006078778A

United States Patent [19]

Murata et al.

[11] Patent Number: 6,078,778

[45] Date of Patent: Jun. 20, 2000

[54] ELECTRIFYING MEMBER COMPRISING AN ELECTRICALLY CONDUCTIVE ELASTOMER, AND ELECTROPHOTOGRAPH APPARATUS USING SAID ELECTRIFYING MEMBER

[75] Inventors: Jun Murata, Kawagoe; Yoshiaki Nishimura, Tokyo; Nobutoshi Hayashi, Machida, all of Japan

[73] Assignee: Canon Kabushiki Kaisha, Tokyo, Japan

[21] Appl. No.: 09/148,670

[22] Filed: Sep. 4, 1998

[30] Foreign Application Priority Data

Sep. 5, 1997 [JP] Japan ..... 9-240754
Dec. 25, 1997 [JP] Japan ..... 9-358097

[51] Int. Cl.[7] ..... G03G 15/16; G03G 15/08

[52] U.S. Cl. ..... 399/313; 361/225; 492/56

[58] Field of Search ..... 399/174, 176, 399/313; 361/225; 492/53, 56

[56] References Cited

U.S. PATENT DOCUMENTS 4,116,894 9/1978 Lentz et al. ..... 521/94
5,751,801 5/1998 Murata et al. ..... 399/176
5,766,753 6/1998 Murata et al. ..... 428/323

FOREIGN PATENT DOCUMENTS 58-87572 5/1983 Japan .
1-142569 6/1989 Japan .
6-161230 6/1994 Japan .
7-164571 6/1995 Japan .
9-85898 3/1997 Japan .

*Primary Examiner*—Joan Pendegrass
*Attorney, Agent, or Firm*—Fitzpatrick, Cella, Harper & Scinto

[57] ABSTRACT

This invention provides an improved electrifying member capable of that can have an electric voltage applied to it to electrify a surface of another member which is to be electrified. In particular, said electrifying member comprises an electrically conductive elastomer obtained by vulcanizing a mixture containing a nitryl rubber, a liquid nitryl rubber, and a non-polar polymer. Therefore, the invention provides an improved electrophotograph apparatus employing the above improved electrifying member, which has a relatively uniform electric resistance and uniform electrifying characteristics, has almost no change in its characteristics even if it has been used for a long time period, and is non-viscous and thus will not stick to a photosensitive body (to be electrified) so that it will not contaminate the photosensitive body.

17 Claims, 3 Drawing Sheets

ELECTRIFYING MEMBER COMPRISING AN ELECTRICALLY CONDUCTIVE ELASTOMER, AND ELECTROPHOTOGRAPH APPARATUS USING SAID ELECTRIFYING MEMBER

BACKGROUND OF THE INVENTION

1. Field of the Invention

The present invention relates to an electrifying member for use in an electrophotograph apparatus. More specifically, this invention relates to an electrifying member that can have an electric voltage applied to it to electrify the surface of another member (to be electrified) so as to effect a desired process such as development and transfer. The present invention also relates to an electrophotograph apparatus employing said electrifying member.

2. Description of the Related Art

With a picture formation apparatus such as an electrophotograph apparatus (including a copying machine and an optical printer) or an electrostatic recording apparatus, conventionally, a corona discharge device has been used to act as an electrifying means for electrifying the surface of a picture carrier medium (a member to be electrified) such as a photosensitive medium or a dielectric medium.

A corona discharge device is useful as an electrifying means for uniformly electrifying the surface of a picture carrier medium so that said surface may have a uniform electric potential. However, since a high voltage electric power source is necessary for a conventional corona discharge device, and since ozone gas will occur due to corona discharge, a conventional corona discharge device is not as satisfactory as is expected in industry.

In order to cope with the above-mentioned problems associated with a conventional corona discharge device, there has been suggested a contact type electrifying device, which is capable of enabling an electrifying member (which has had a predetermined electric voltage applied thereto) to get close to or get in contact with the surface of a medium (to be electrified) so as to electrify its surface. With the use of such a contact type electrifying device, it is possible to reduce the voltage of the electric power source, and to inhibit the generation of ozone gas.

Usually, an electrifying member is required to possess a predetermined semiconductivity to prevent leakage which maybe caused by a damaged portion such as a pin hole formed on the surface of a medium (to be electrified) such as a photosensitive medium.

When a transfer roller is used in a picture formation apparatus such as a copying machine, such a transfer roller serves to transfer a toner picture from a picture carrier (such as a photosensitive medium, intermediate transfer medium or transfer drum) to a paper. In detail, a toner picture is developed on a photosensitive medium, the transfer roller is pressed against the photosensitive medium with a paper interposed therebetween. Then, by supplying electric charges having a polarity opposite to that of the toner of the toner picture, the toner of the photosensitive medium is absorbed by the paper so as to effect a desired transfer. Here, the quality of a picture is greatly affected by the density of the electric charges supplied to the paper. Namely, if there is a low electric charge density, the toner absorption force will be weak, presenting a problem called "black spots around line image" if using a dry paper. On the other hand, if there is a high electric charge density, it is likely that a problem called "blurring" will occur due to a possible electrification of reversed polarity. As a result, it is difficult to print a high quality picture.

Further, if the electric charge density is not uniform over a paper, it will be difficult to obtain a uniform concentration distribution of transfer using a black color, and some sand-like spots will occur on a transcribed paper. For this reason, it is desirable to provide a uniform electric charge density over the paper so as to obtain a uniform electric conductivity on the paper surface.

To meet the above requirements, it has been suggested to use an electrically conductive rubber roller which may be manufactured in the following manner.

Specifically, fine metal particles are coated with carbon black, graphite, or a metal oxide such as titanium dioxide, tin oxide, or a metal powder such as Cu or Ag, so as to obtain electrically conductive particles. Then, the electrically conductive particles are dispersed in a rubber material, thereby obtaining an electrically conductive rubber roller.

However, with the rubber roller with the above electrically conductive particles dispersed in it, a large amount of such electrically conductive particles have to be incorporated in the rubber roller in order to adjust the electric resistance. Therefore, it is difficult to obtain a uniform resistance distribution because it is difficult to form a uniform dispersion of the conductive particles throughout the whole volume of the rubber roller. As a result, it is difficult to obtain a uniform electrification effect, and it is likely to cause damage to the photosensitive medium due to a partial leak.

In addition to the use of the above electrically conductive particles to form an electrically conductive rubber, it is also possible to use ion type electrically conductive rubber. Such ion type electrically conductive rubber is formed by adding an ion type electrolyte such as $LiClO_4$, NaSCN or $LiCF_3SO_4$ so as to adjust its resistance.

This, however, will cause some other problems. Namely, since an electrolyte will drift to the surface of the rubber material with the passing of time, the electric resistance of the rubber roller will change and a photosensitive medium (provided as an outer layer) will be contaminated due to the electrolyte. Moreover, the resistance value will also change due to voltage application.

As to characteristics other than electric resistance, it is required that a transfer roller should have a low hardness in order to ensure an exact contact with a photosensitive medium, to alleviate possible damage to the photosensitive medium, and to ensure a stabilized movement of paper.

In order to ensure a low hardness for a transfer roller, it is usual to add a plasticizer or an oil to the rubber material so as to form a transfer roller with a sufficiently low hardness. However, since such a plasticizer or oil may also drift to the surface of a rubber roller, there is also a problem that a material (to be electrified) such as a photosensitive medium can be contaminated, and its resistance and hardness may change with the passing of time.

Japanese Patent Laid-open Nos. 58-87572 and 1-142569 have disclosed that using a hydrin rubber may provide good electrical conductivity for the same reason as discussed above. However, since an epichlorohydrin rubber has a large viscosity, it is impossible to obtain a sufficient non-adhesive effect even if it is blended with a non-polar polymer (as disclosed in Japanese Patent Laid-open No. 7-164571). Accordingly, after being used for a long period, toner will be absorbed on the surface of the electrifying member, hence damaging the electrical characteristics of the rubber roller.

On the other hand, epichlorohydrin rubber still remains in use in making a transfer roller, for it offers a good and uniform electrical conductivity without containing any electrically conductive additives. However, since an epichlorohydrin rubber will absorb a halogen gas such as hydrogen chloride occurring during a vulcanization process, it is difficult to obtain a uniform electric characteristic in a manufacturing lot. To cope with this problem, it has been suggested to use various acid neutralizing agents. One sort of acid neutralizing agent is a trilead tetroxide which has excellent reactivity, as disclosed in Japanese Patent Laid-open No. 6-161230. However, since it contains lead, the allowable amount of its use is usually restricted.

SUMMARY OF THE INVENTION

In view of the above-discussed problems associated with the above-mentioned prior arts, it is an object of the present invention to provide an improved electrifying member having a relatively uniform electric resistance and uniform electrifying characteristics.

Another object of the present invention is to provide an electrifying member having almost no change in its characteristic even if it has been used for a long time period.

A further object of the present invention is to provide an electrifying member which is non-viscous and thus will not stick to an electrified member so that it will not contaminate the electrified member.

A still further object of the present invention is to provide an electrifying member having a uniform electric characteristic in a manufacturing lot.

One more object of the present invention is to provide a process cartridge and an electrophotograph apparatus, both using the above improved electrifying member.

According to a first aspect of the present invention, there is provided an electrifying member capable of having an electric voltage applied to it to electrify a surface of another member which is to be electrified, said electrifying member comprising an electrically conductive elastomer obtained by vulcanizing a mixture containing a nitryl rubber, a liquid nitryl rubber and a non-polar polymer.

According to a second aspect of the present invention, there is provided an electrifying member capable of having an electric voltage applied to it to electrify a surface of another member which is to be electrified, said electrifying member comprising an electrically conductive elastomer obtained by vulcanizing a mixture containing an epichlorohydrin rubber. In particular, a vulcanized product obtained by the above vulcanizing process contains a hydrotalcite.

According to a third aspect of the present invention, there is provided a process cartridge including an electrifying member and a photosensitive medium, both of which are integrally formed into a cartridge that may be attached to and detached from the main body of an electrophotograph apparatus, characterized in that said electrifying member is made in accordance with the first and second aspects of the present invention.

According to a third aspect of the present invention, there is provided an electrophotograph apparatus having an electrifying member and a photosensitive medium, characterized in that said electrifying member is made in accordance with the first and second aspects of the present invention.

In the present invention, nitryl rubber is used as a polymer in the electrically conductive elastomer of the electrifying member. Since the nitryl rubber has a cyano group CN— in its molecule which has a strong electronic suction force, the polymer molecule is in an electrically negative charged condition. Thus, a cyano group CN— will combine with a hydronium ion in liquid to form a complex ion. Therefore, when the complex ion moves or drifts, the nitryl rubber will present an electrical conductivity.

In this way, since the polymer itself presents an electrical conductivity, it provides a uniform distribution of electric resistance throughout the whole material in a better condition than a conventional material whose electric resistance can only be adjusted by dispersing electrically conductive particles.

Therefore, with the nitryl rubber used as a polymer in the electrically conductive elastomer of the electrifying member, it is not necessary to add any migratory electrically conductive agent such as a surface active agent or a low molecular weight electrolyte. Thus, the nitryl rubber will not have any resistance change with the passing of time even if it is used for a long time.

Usually, a nitryl rubber is a polymer having a strong polarity, so that it presents a strong adhesion. If an electrically conductive elastomer containing the nitryl rubber is caused to press against a photosensitive medium (acting as a medium which is to be electrified) for a long time period, the elastomer will get stuck to the photosensitive medium. As a result, some components of the electrifying member will migrate to the surface of the electrified member, hence causing a problem that the roller will get stuck and thus not rotate. However, in the present invention, since the nitryl rubber (acting as a polymer having a strong polarity) is blended with a non-polar polymer, it has the desired non-adhesive property.

Further, according to the present invention, since the electrically conductive elastomer contains a liquid nitryl rubber that is liquid at room temperature, i.e. 25° C., it is sure that the hardness of the electrifying member may be properly adjusted to an appropriate value, and that a sufficient nip width between the electrifying member and the electrified member may be obtained, thereby effecting a desired uniform electrification.

In particular, since the liquid nitryl rubber has a molecular structure similar to the nitryl rubber, it has good compatibility with the nitryl rubber, thereby ensuring that the liquid nitryl rubber will not easily bleed to the surface of the electrically conductive elastomer and thus ensuring the desired non-adhesive property for the electrifying member. Further, adding the liquid nitryl rubber will not influence the electric resistance of the electrifying member; instead, this addition is effective for reducing the hardness of an electrically conductive elastomer of an electrifying member.

DESCRIPTION OF THE PREFERRED EMBODIMENTS

Figure 1:
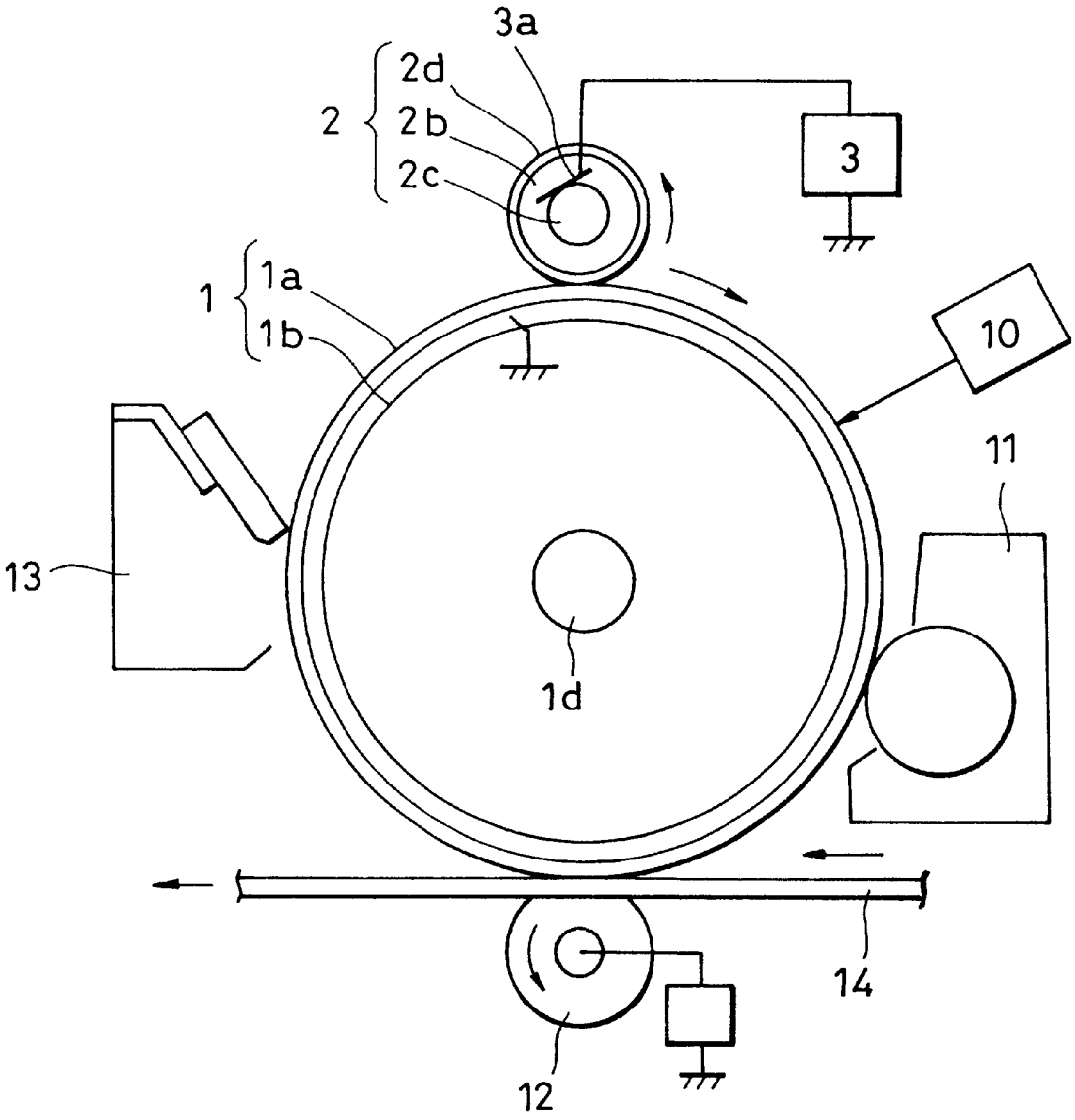
FIG. 1 is an explanatory view schematically illustrating an electrophotograph apparatus employing an electrifying member made according to the present invention.

Non-polar polymer which is used to form an electrically conductive elastomer in the present invention, is a high molecular weight material having no large dipole moment within its molecule structure. Such material is usually a high molecular weight material having a small dielectric constant, preferably, not more than 5 (according to the regulation ASTM D-150). As such a non-polar polymer (dielectric constant), it is possible to use IR (Isoprene Rubber)(2–3), BR (Butadiene Rubber)(2–3), SBR (Styrene Butadiene Rubber)(2.9–3.0), EPDM (Ethylene Propylene Diene Rubber)(3.1–3.4) IIR (Isobutylene Isoprene Rubber) (2.1), olefin elastomer, SEBS (styrene-ethylene-butylene-styrene) elastomer, or polystyrenic elastomer. Further, by blending together two or more of the above polymers, it is possible to adjust the electric resistance of the polymer mixture so as to obtain a higher resistance, thereby making it possible to meet various requirements concerning electric resistance for different types of electrophotograph apparatus.

In particular, if an electrically conductive elastomer does not have sufficient resistance against ozone, or if resistance against aging is considered to be extremely important, it is preferred to use EPDM (Ethylene Propylene Diene Rubber). Particularly, during the process of vulcanization, it is preferred to use an EPDM (Ethylene Propylene Diene Rubber) having an iodine value of 20 or more, preferably 30 or more.

Preferably, epichlorohydrin rubber is added into the electrically conductive elastomer.

Since there is no double bond contained in the epichlorohydrin rubber, application of voltage to the rubber will not easily cause any change in its physical and chemical properties. Further, since the epichlorohydrin rubber does not contain double bonds in its molecular structure, it is sure to protect the rubber material from any deterioration which may possibly be caused due to oxygen or ozone, thereby obtaining a stability owing to its long durability. Accordingly, if the above nitryl rubber is partially replaced by an epichlorohydrin rubber, it is possible to obtain a non-adhesive property and increase its durability.

Preferably, the amount of nitrile contained in the nitryl rubber is 15–40 wt %. Namely, in order that the polarity is not so strong and the adhesion is relatively small, and to ensure excellent compatibility with the non-polar polymer, the amount of nitrile contained in the nitryl rubber is preferably 40 wt % or less. On the other hand, in order to ensure the desired electrical conductivity, the amount of nitrile contained in the nitryl rubber is preferably 15 wt % or more.

As to the mixing ratio of the nitryl rubber with the non-polar polymer, it is preferable that the nitryl rubber is contained at an amount of 25–90 wt %, while the non-polar polymer is contained at an amount of 10–75 wt %. Namely, in order for the electrically conductive elastomer to have low adhesion, it is preferable that the non-polar polymer is contained at an amount of 10 wt % or more. On the other hand, in order to ensure a uniform electrical conductivity throughout the whole mixture, it is preferable that the non-polar polymer is contained at an amount of 75 wt % or less.

When an epichlorohydrin rubber is used as a polymer in the electrically conductive elastomer, it is preferable to employ a hydrotalcite as an acid neutralizing agent. Namely, hydrotalcite has a constitutional formula that may be indicated as follows: $Mg_{1-x}Al_x(OH)_2(CO_3)_{x/2}.mH_2O$ ($0<x\leqq 0.5$, m is a positive number). That is, such hydrotalcite is a water bearing strata compound containing basic magnesium, aluminium, hydroxide, carbonate, and hydrate. A hydrogen chloride generated during the vulcanization reaction press on the epichlorohydrin, is easily replaced by a carbonate ion contained in the water bearing strata compound, so that chlorine ion is combined into a newly formed crystal structure. A compound obtained in this way is different from other metal oxides, and it is insoluble in water. Further, such compound has excellent dispersibility, and its physical properties are hardly affected by its kneading condition or other treatments. Moreover, a compound having a constitutional formula $Mg_{1-x}Al_xO_{1+x/2}$ which is obtained by treating the above compound at a high temperature, will similarly absorb anions together with water, thereby providing some effects similar to the above compound. In the present invention, the compound obtained by treating the previous compound at a high temperature is also called hydrotalcite.

What is used as a cross-linking agent in the above reaction is preferably an ethylene thiourea in order to obtain high reactivity. Further, in order to ensure an improved operation environment, it is preferred to use 2,3 dimethyl quinoxaline derivative. Particularly, to ensure good reactivity and operational safety, it is preferable to use a 6-methyl quinoxaline-2,3-dithio carbonate.

As to the above-mentioned epichlorohydrin rubber, since it already has a structure for providing electrical conductivity obtainable due to a specific polymer structure, an electrically conductive elastomer may be formed by using such a material without any necessity of dispersing electrically conductive particles. Therefore, a vulcanized product may be obtained by vulcanizing a mixture containing the epichlorohydrin rubber, an electrically conductive elastomer containing hydrotalcite may be used in the vulcanized product so as to form a desired electrifying member. This has been proved to be useful for ensuring operational safety and for obtaining a uniform electrical characteristic throughout an entire manufacturing lot. A final product may be used as a process cartridge and an electrifying material having a uniform electric characteristic.

The present invention will be described in more detail with the reference to the accompanying drawings.

Figure 3:
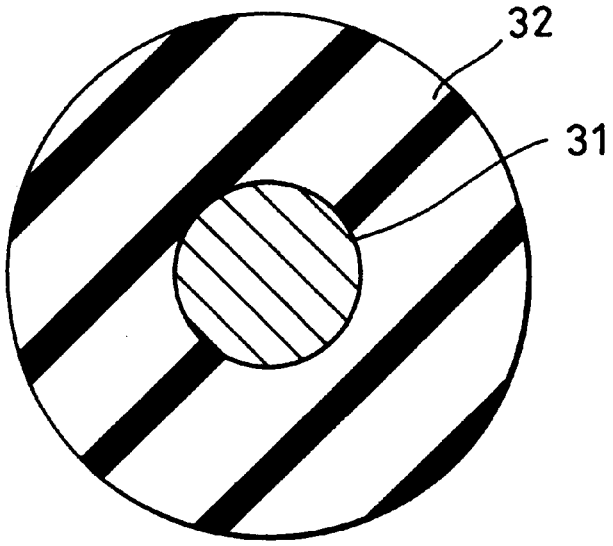
FIG. 3 is a cross sectional view schematically illustrating a transfer roller made according to the present invention.

FIG. 3 is a cross sectional view schematically illustrating a condition where an electrifying member made according to the present invention is used as a transfer roller.

Referring to FIG. 3, a transfer roller includes an electrically conductive cylindrical core member 31 which is made of a metal, and an electrically conductive elastomer layer 32 formed on the outer periphery surface of the core member 31.

An electrically conductive elastomer layer, for use according to the present invention should be capable of applying a bias voltage to a paper, and should have a sufficient resilience capable of uniformly pressing on a paper. Preferably, the electrically conductive elastomer layer has a volume resistance of $1\times10^5$–$1\times10^{12}$ Ω. When the electrically conductive elastomer layer is used to form a transfer roller, it is preferred that such an elastomer layer has a relatively low hardness so as to prevent the problem that the center portion of a picture would not be printed.

The above hardness is a sponge hardness (asker C), preferably at 20–80°.

The electrically conductive elastomer of the present invention may be used in the form of either a solid state or an expanded state.

By properly blending with a non-polar polymer, it is possible to prevent the above electrically conductive elastomer from sticking to an electrified medium such as a photosensitive medium. In order to more exactly prevent such sticking, it is also possible to modify the surface structure of the electrically conductive elastomer. For instance, the surface of the electrically conductive elastomer may be blended with some particles of release agent such as silicon particles or fluorine resin particles, or the same surface may be treated with a silane coupling agent or a reactive fluorinic surface active agent. Alternatively, the surface of the electrically conductive elastomer may be washed with a hydrochloric solvent such as a diluted hydrochloric acid.

On the other hand, it is preferable to perform a treatment of UV (ultraviolet) irradiation for treating the surface of the electrically conductive elastomer, since such kind of treatment is simple in operation and can provide a desired effect.

Further, if a softening agent such as an oil is to be employed, it is preferred to use a non-migratory liquid rubber. With the use of a non-migratory liquid rubber, the surface of the rubber (elastomer) may be oxidized, and may be hardened due to a cross-linking reaction between diene bonds, thereby becoming non-adhesive. In addition, it has been found that a non-migratory liquid rubber will have less influence on the physical properties of the elastomer than other sorts of treatments using additives or coating treatment.

When a treatment of UV (ultraviolet) irradiation is performed for treating the surface of the electrically conductive elastomer, the wave length of an ultraviolet ray is 180–600 nm. In particular, a shorter wave length is proved to be more effective for treating the above surface. However, an intensity of the ultraviolet irradiation at each time is 10 $mW/cm^2$–100 $mW/cm^2$.

Further, where an electrifying member is in the form of a roller, the roller may be rotated while an ultraviolet ray is irradiating on it, so that the roller may be uniformly and completely irradiated by the ultraviolet ray, thereby rendering it possible to effectively perform the surface treatment in a short time.

The surface of the electrifying member, after being treated in the above described manner, has an excellent releasing characteristic so that excessive toner powder or paper powder attached to said surface may be easily removed.

FIG. 1 is an explanatory cross-sectional view schematically illustrating an electrophotograph apparatus using an electrifying member made according to the present invention.

In FIG. 1, reference numeral 1 represents a photosensitive body serving as a member to be electrified. In detail, the photosensitive body 1 includes an electrically conductive substrate layer 1*b* made of aluminium, a photoconductive layer 1*a* formed on the outer surface of the substrate layer 1*b,* thereby forming a drum type electrophotograph photosensitive body. A reference numeral 1*d* represents a supporting shaft for supporting the drum so that the photosensitive body 1 may rotate in a clockwise direction at a predetermined periphery velocity.

Referring again to FIG. 1, reference numeral 2 represents an electrifying member positioned in contact with the photosensitive body 1 and capable of performing a primary electrification treatment for electrifying the surface of the photosensitive body 1 so as to enable said surface to obtain a predetermined polarity and a predetermined electric potential. Such an electrifying member is required to have a uniform electric conductivity. Since in the present embodiment the electrifying member is in the form of a roller, hereinafter it will be occasionally referred to as an electrifying roller. In detail, the electrifying roller 2 includes a metal core member 2*c,* an electrically conductive elastic primer layer 2*b,* formed on the outer periphery surface of the metal core member 2*c,* and a resistance outer layer 2*d* formed (if necessary) on the outer periphery surface of the primer layer 2*b.* The opposite end faces of the metal core member 2*c* are pressed by a pair of pressing means (not shown) in a manner such that the electrifying roller 2 is rotatable by the rotation of the photosensitive body 1. In fact, it has been found that the material made in the present invention may be effectively used to form the resistance layer 2*d* and the electrically conductive elastic layer 2*b.*

The resistance layer 2*d* is used to prevent possible damage to the electrifying member 2 and the photosensitive body 1, which may be caused due to the fact that some defects such as pin holes are formed on the photosensitive body 1 and electric currents are all collected herein. For this reason, the resistance layer 2*d* is required to have a resistance value of $1\times10^2$–$1\times10^9$ Ω.

Then, with the use of an electric power source 3 and a friction electric source 3*a,* a predetermined direct current (DC) bias or a (direct current+alternating current)(DC+AC) bias is applied to the metal core member 2*c,* so that the outer surface of the rotary photosensitive body 1 is electrified, thereby enabling the same surface to obtain a predetermined polarity and to be maintained at a predetermined electric potential. The surface of the photosensitive body 1, after having been treated uniformly in the electrification process using the electrifying member 2, is subjected to an exposure treatment of object picture information (laser beam scanning exposure, or slit exposure) with the use of an exposing means 10. In this way, an electrostatic potential picture may be formed on the outer periphery surface of the photosensitive body 1.

The above potential picture is then successively developed into a visible toner picture, by virtue of a developing means 11. Subsequently, the toner picture is successively transferred onto a paper 14, with the use of a transfer means 12. The paper 14 is supplied from a paper supplier (not shown) and is moved through a transferring section positioned between the photosensitive body 1 and the transfer means 12, having an appropriate timing which is synchronized with the rotation of photosensitive body 1. In the present invention, the transfer means 12 is a transfer roller. At this moment, by electrifying the back surface of the paper 14 to let it bear electric charges having a polarity opposite to that of the toner, the toner picture on the outer surface of the photosensitive body 1 may be transferred onto the surface of the paper 14.

The paper 14, after having received the toner picture, is separated from the surface of the photosensitive body 1, and moved to a picture fixation means (not shown) in which the toner picture is fixed on the paper so as to be produced as a printed picture. If the back surface of the paper 14 is also to receive a toner picture, the paper 14 will be moved to a re-transporting means so as to be moved to the same transfer section.

Upon completion of transfer of the toner picture in the above manner, the surface of the photosensitive body 1 is cleaned by a cleaning means 13 to remove some contaminants such as remaining toner.

Although it has been shown in this embodiment that the electrifying member 2 may be made into a roller type, it is also possible that such an electrifying member may be made into other shapes such as a plate, a block or a belt.

Further, although it has been described in the present embodiment that the roller type electrifying member 2 is driven by the photosensitive body 1 whose periphery surface moves and is to be electrified, such an electrifying member 2 may also be a non-rotary type, or alternatively, the electrifying member 2 may be an actively rotating type which is adapted to rotate independently at a predetermined periphery speed in the same direction in which the photosensitive body 1 rotates or in a direction opposite to the rotation of the photosensitive body 1.

With the electrophotograph apparatus of the present invention, two or more of the above members including the photosensitive body, the developing means and the cleaning means, may be combined into a process cartridge. Such kind of cartridge may be detachably attached to a picture formation apparatus such as a copying machine, or a laser beam printer. For instance, at least one of the electrifying member, the developing means and the cleaning means, may be combined with the photosensitive body so that both of them are supported together to form a cartridge which may be detachably installed on the main body of the electrophotograph apparatus. Alternatively, such cartridge may be detachably installed on the main body of the electrophotograph apparatus through guide means such as rail members.

Further, when an electrophotograph apparatus is used as a copying machine or a printer, an original picture is read, and the information read from the original is converted into some kind of signals, so that an optical picture exposure may be effected by using such signals through laser beam scanning, driving LED (Light Emitting Diode) array, or driving liquid crystal shutter array.

Figure 2:
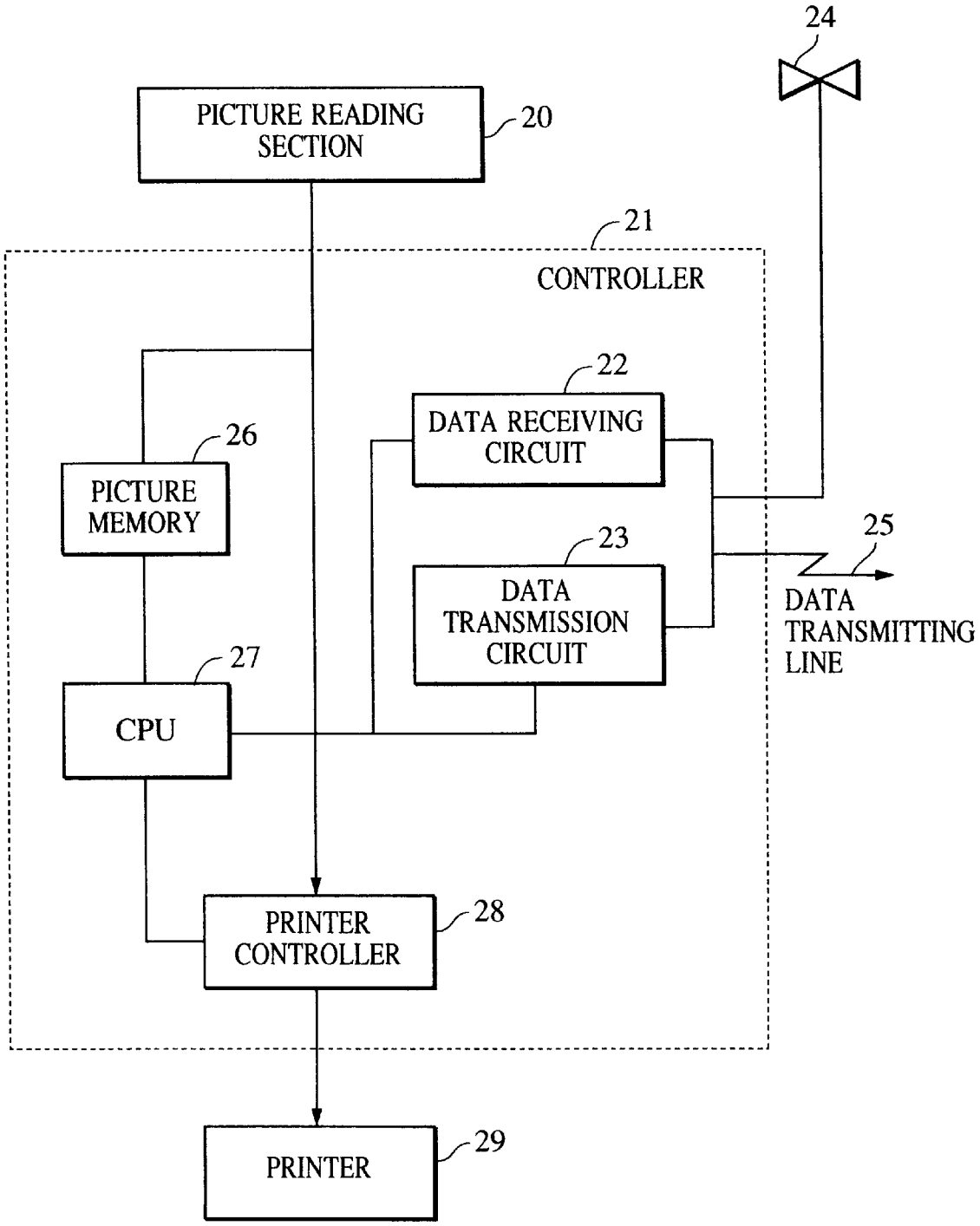
FIG. 2 is a block diagram indicating a facsimile system whose printer is an electrophotograph apparatus using the electrifying member made according to the present invention.

Moreover, when an electrophotograph apparatus is used as a printer of a facsimile machine, the optical picture exposure may become an exposure for printing received data. FIG. 2 is a block diagram indicating an example of such a process. As shown in FIG. 2, a controller 21 is provided to control a picture reading section 20 and a printer 29, while the controller 21 as a whole is controlled by a CPU (Central Processing Unit) 27. The data read from the picture reading section 20 is sent through a data transmission circuit 23 to the printer 29. Meanwhile, some predetermined picture data are stored in a picture memory 26. Referring again to FIG. 2, a printer controller 28 is provided to control the printer 29, whilst reference numeral 24 represents a telephone.

Referring once again to FIG. 2, picture data is transmitted from a remote terminal (not shown) through a data transmitting line 25 and is demodulated in a data receiving circuit 22. Subsequently, the CPU 27 operates to perform composite processing on the picture data which are then successively stored in the memory 26. Upon storing at least one page picture in the memory 26, the picture of that page is then recorded. At this time, the CPU 27 operates to read out the picture information of one page from the memory 26, and produce picture information composed in the printer controller 28. Once the printer controller 28 receives the picture information of one page from the CPU 27, the printer 29 is operated so as to record the picture information of the one page.

When the printer 29 is in its process of performing a predetermined recording, the CPU 27 will begin to receive picture information of the next page. Therefore, receiving and recording of picture information may be accomplished in the above manner.

On the other hand, a photosensitive layer of the photosensitive body is provided and supported on an electrically conductive material. Such an electrically conductive material may be, for example, an aluminium material, an aluminium alloy, a stainless steel material, or a nickel material. However, for use as an electrically conductive material, it is also possible to use plastic or glass on which is vacuum deposited an aluminium material, an aluminium alloy or an alloy of indium oxide and tin oxide.

Further, it is possible to provide a middle layer between the electrically conductive support body and the photosensitive layer, with said middle layer having both a barrier function and an adhesion function. Such middle layer may be made from casein, polyvinylalcohol, nitrocellulose, ethylene-acrylic acid copolymer, polyamide (nylon 6, nylon 66, nylon 610, copolymer nylon), polyurethane, gelatin, or aluminium oxide. Moreover, such middle layer has a thickness of 5 $\mu$m or less, preferably 0.5–3 $\mu$m. In order to make full use of the function of the middle layer, said middle layer is preferred to have an electrical resistance of $10\times10^7$ Ω.

The photosensitive layer may be formed by applying an organic or inorganic photoconductive medium together with a binder resin. Alternatively, such a photosensitive layer may be formed by vapor deposition.

Preferably, the photosensitive layer is in the form of a laminated structure including an electric charge generating layer and a electric charge transporting layer, rendering the two functions (charge generation and charge transportation) to be in a mutually separated condition.

The electric charge generating layer may be formed by vapor deposition of electric charge generating substance, such as azo pigment, phthalocyanine pigment or quinone pigment. Alternatively, such an electric charge generating layer may be formed by applying one of the above substances together with an appropriate binder resin (if possible, such binder resin may be omitted).

In practice, the electric charge generating layer has a thickness of 0.01–30 $\mu$m, preferably 0.05–2 $\mu$m.

The electric charge transporting layer is formed by dissolving an electric charge transporting substance such as a hydrazone compound, styryl compound, oxazole compound, or triallylamine compound in a film-forming binder resin. In practice, the electric charge transporting layer has a thickness of 5–50 $\mu$m, preferably 10–30 $\mu$m. In addition, to prevent deterioration possibly caused due to ultraviolet irradiation, it is preferred to form a protective layer on the photosensitive layer.

The present invention will be described in further detail through the following working examples.

EXAMPLE 1

FIG. 3 is a cross sectional view schematically illustrating a transfer roller made according to the present embodiment. In FIG. 3, reference numeral 32 is an electrically conductive elastomer layer and reference numeral 31 is an electrical conductive cylindrical core member.

In detail, the transfer roller includes a metal core member which has a diameter of 6 mm. Such metal core member is electrically conductive and may be made of stainless steel, iron without any coating, or iron coated with nickel or nickel/chrome in order to effect rust-proofing.

A mixture for forming the electrically conductive elastomer layer includes 70 parts by weight of NBR (nitryl rubber) (trade name: N230S; nitryl component: 35 wt %; manufactured by JAPAN Synthetic Rubber Co., Ltd.), 30 parts by weight of EPDM (trade name: EPT4070; iodine value: 22; manufactured by Mitsui Chemistry Co., Ltd.), 5 parts by weight of zinc oxide, 1 part by weight of stearic acid, 40 parts by weight of calcium carbonate, 20 parts by weight of liquid NBR (trade name: N280; manufactured by JAPAN Synthetic Rubber Co., Ltd.), 1.5 parts by weight of sulfur, 2 parts by weight of a vulcanization accelerator DM (Dibenzothiazyl disulfide), 1 part by weight of tetrathiuram disulfide (TT).

At first, a mixture having the above composition was formed into a rubber tube by extrusion molding, followed by vulcanization at a temperature of 160° C. for 30 minutes. Then, the rubber tube was further vulcanized at a temperature of 150° C. for 30 minutes, so as to obtain a vulcanized rubber product.

The rubber tube was then forced over the above metal core member coated with an electrically conductive adhesive. Subsequently, the surface of the rubber tube was abraded, thereby obtaining an elastic roller having a diameter of 12 mm. Afterwards, a measuring device shown in FIG. 4 was used to measure the electric resistance of one hundred of the elastic rollers under conditions where an aluminium drum is rotated to drive the elastic roller and a 500 g weight is applied to each end of the elastic roller, to press the elastic roller to the aluminum drum. This condition is the same in the following examples and comparative examples. It was found that after the roller had been placed for 24 hours in an environment of N/N (23° C., 60% R.H.) and when the direct current voltage is 2 kV, the electric resistance is $3\times10^8$–$3.2\times10^8$ Ω (non-uniform resistance distribution: max./min.=1.07), and the hardness is 65° asker C.

Then, the above roller was used as a transfer roller in an electrophotograph apparatus shown in FIG. 1. At this time, the process speed is 100 mm/sec, and the photosensitive drum has a diameter of 30 mm. The photosensitive drum is electrified to bear negative charges, and toner is electrified to bear positive charges, the electric voltage applied to the transfer roller is −3 kV, while the electric voltage for cleaning is +1.5 kV.

When the above transfer roller was used to print a line drawing, a full black picture, or a half tone picture on a dried paper in an environment of L/L (15° C., 10% R.H.)—H/H (32° C., 80% R.H.), all pictures obtained were clear and distinct.

Further, when the above transfer roller was used to print a picture on either side of a dried paper in an environment of L/L, it was found that effects similar to the above may be obtained.

Moreover, when the above transfer roller was used to continuously print pictures on 200,000 pieces of paper, it was found that no defective pictures occurred.

In addition, when the same transfer roller is caused to press against an organic photosensitive body with a total force of 1 kg under condition of 40° C., 95% R.H. for two weeks, it was found that no trouble such as sticking occurred.

Further, the transfer roller was treated with the use of an ultraviolet ray irradiation device (using wave lengths of 185 nm and 254 nm as main components) under conditions of 40 mW/cm$^2$ for 4 minutes. Then, the transfer roller was forced to press against the organic photosensitive body with a total force of 1 kg under conditions of 40° C., 95% R.H. for 30 days, it was found that no trouble such as sticking occurred.

When the photosensitive body was used to print pictures in an environment of N/N, printed pictures of good quality were obtained without any trace (indicating the fact of having been pressed) remaining thereon.

EXAMPLE 2

Example 2 was performed almost in the same manner and under the same conditions as those in Example 1 except that the mixture for forming the electrically conductive elastomer layer includes 70 parts by weight of NBR (trade name: DN201; nitryl component: 33.5 wt %; manufactured by Nippon Zeon Co., Ltd.), 30 parts by weight of BR (trade name: BR-01; manufactured by JAPAN Synthetic Rubber Co., Ltd.), thereby obtaining a desired transfer roller.

Then, a measuring device was used to measure the electric resistance of the elastic roller under conditions where an aluminium drum is rotated to drive the elastic roller, and it was found that after the roller had been placed for 24 hours in an environment of N/N and when the direct current voltage is 2 kV, the electric resistance is $3\times10^8$–$3.3\times10^8$ Ω (non-uniform resistance distribution: max./min.=1.06), and the hardness is 65° a asker.

When the transfer roller was evaluated in the same manner as that in Example 1, it was found that the same results as those in Example 1 were obtained.

EXAMPLE 3

Example 3 was performed almost in the same manner and under the same conditions as those in Example 1 except that, the mixture for forming the electrically conductive elastomer layer includes 40 parts by weight of NBR (trade name: N240S; nitryl component: 26 wt %; manufactured by JAPAN Sythetic Rubber Co., Ltd.), 60 parts by weight of EPDM (trade name: EP35; iodine value: 26; manufactured by JAPAN Synthetic Rubber Co., Ltd.), thereby obtaining a desired transfer roller in the same manner as that in Example 1.

Figure 4:
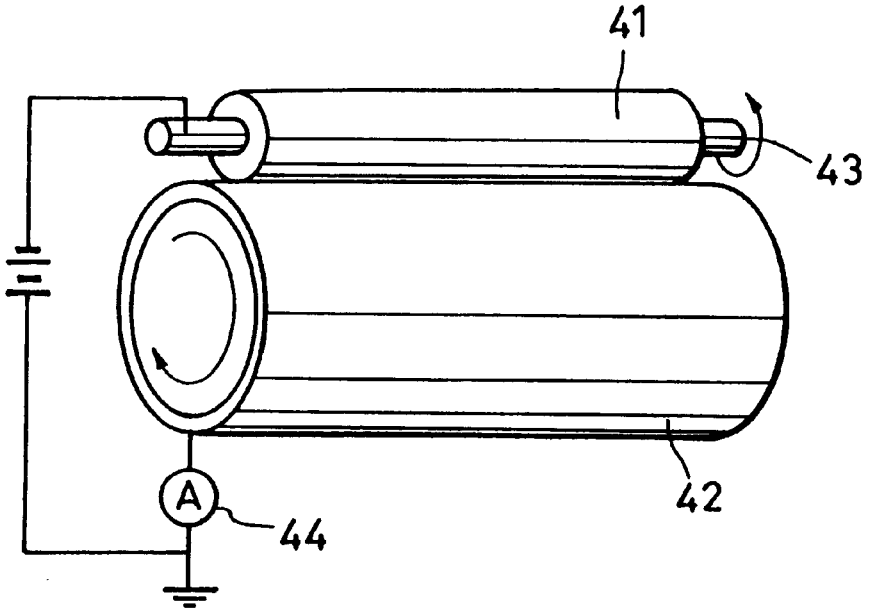
FIG. 4 is an explanatory view schematically illustrating the structure of an electric resistance measuring apparatus for measuring the resistance of an electrically conductive resilient roller.

Then, a measuring device shown in FIG. 4 was used to measure the electric resistance of the elastic roller under conditions where an aluminium drum is rotated to drive the elastic roller, and it was found that after the roller had been placed for 24 hours in an environment of N/N and when the direct current voltage is 2 kV, the electric resistance is $8.8\times10^8$–$9.5\times10^8$ Ω (non-uniform resistance distribution: max./min.=1.06), and the hardness is 66° asker.

When the transfer roller was evaluated in the same manner as that in Example 1, it was found that the same results as those in Example 1 were obtained.

EXAMPLE 4

Example 4 was performed almost in the same manner and under the same conditions as those in Example 1 except that the mixture for forming the electrically conductive elastomer layer includes 40 parts by weight of NBR (trade name: N250S; nitryl component: 20 wt %; manufactured by JAPAN Synthetic Rubber Co., Ltd.), 30 parts by weight of hydrogenated NBR (trade name: 2030, nitryl component: 36.2 wt %; manufactured by Nippon Zeon Co., Ltd.) obtained by adding hydrogen to double bonds, 30 parts by weight of BR (trade name: BR-01; manufactured by JAPAN Synthetic Rubber Co., Ltd.), thereby obtaining a desired transfer roller in the same manner as that in Example 1.

Then, a measuring device shown in FIG. 4 was used to measure the electric resistance of the elastic roller under a conditions where an aluminium drum is rotated to drive the elastic roller, and it was found that after the roller had been placed for 24 hours in an environment of N/N and when the direct current voltage is 2 kV, the electric resistance is $6.0\times10^8$–$6.4\times10^8$ Ω (non-uniform resistance distribution: max./min.=1.07), and the hardness is 64° asker.

When the transfer roller was evaluated in the same manner as that in Example 1, it was found that the same results as those in Example 1 were obtained.

EXAMPLE 5

Example 5 was performed almost in the same manner and under the same conditions as those in Example 1 except that, the mixture for forming the electrically conductive elastomer layer includes 70 parts by weight of NBR (trade name: N220S; nitryl component: 20 wt %; manufactured by JAPAN Synthetic Rubber Co., Ltd.), 30 parts by weight of SBR (trade name: 1502; manufactured by Nippon Zeon Co., Ltd.), thereby obtaining a desired transfer roller in the same manner as that in Example 1.

Then, a measuring device shown in FIG. 4 was used to measure the electric resistance of the elastic roller under a conditions where an aluminium drum is rotated to drive the elastic roller, and it was found that after the roller had been placed for 24 hours in an environment of N/N and when the direct current voltage is 2 kV, the electric resistance is $2.8\times10^8$–$3\times10^8$ Ω (non-uniform resistance distribution: max./min.=1.07), and the hardness is 70° asker.

When the transfer roller was evaluated in the same manner as that in Example 1, it was found that the same results as those in Example 1 were obtained.

EXAMPLE 6

Example 6 was performed almost in the same manner and under the same conditions as those in Example 1 except that, the mixture for forming the electrically conductive elastomer layer includes 50 parts by weight of NBR (trade name: N230S; nitryl component: 26 wt %; manufactured by JAPAN Synthetic Rubber Co., Ltd.), 10 parts by weight of EPDM (trade name: ETP4070; iodine value: 22; manufactured by Mitsui Chemistry Co., Ltd.), thereby obtaining a desired transfer roller in the same manner as that in Example 1.

Then, a measuring device shown in FIG. 4 was used to measure the electric resistance of the elastic roller under a conditions where an aluminium drum is rotated to drive the elastic roller, and it was found that after the roller had been placed for 24 hours in an environment of N/N and when the direct current voltage is 2 kV, the electric resistance is $3.8\times10^8$–$4.1\times10^8$ Ω (non-uniform resistance distribution: max./min.=1.08), and the hardness is 68° asker.

When the transfer roller was evaluated in the same manner as that in Example 1, it was found that the same results as those in Example 1 were obtained.

EXAMPLE 7

Example 7 was performed almost in the same manner and under the same conditions as those in Example 1 except that the mixture for forming the electrically conductive elastomer layer includes 50 parts by weight of NBR (trade name: N240S; nitryl component: 26 wt %; manufactured by JAPAN Synthetic Rubber Co., Ltd.), 30 parts by weight of EPDM (trade name: ETP4070; iodine value: 22; manufactured by Mitsui Chemistry Co., Ltd.), 20 parts by weight of epichlorohydrin rubber (EPICHLONER-H, epichlorohydrin 110%, manufactured by DAISO Co., Ltd.), thereby obtaining a desired transfer roller in the same manner as that in Example 1.

Then, a measuring device shown in FIG. 4 was used to measure the electric resistance of the elastic roller under conditions where an aluminium drum is rotated to drive the elastic roller, and it was found that after the roller had been placed for 24 hours in an environment of N/N and when the direct current voltage is 2 kV, the electric resistance is $2.6\times10^8$–$2.8'10^8$ Ω (non-uniform resistance distribution: max./min.=1.08), and the hardness is 64° asker.

After the transfer roller was used to continuously print pictures on 200,000 pieces of papers for a durability test, it was found that there was only minimal change in its electric resistance. Therefore, when the transfer roller had continuously printed pictures on 100,000 pieces of papers, it was found that the picture quality was just the same as that at the initial stage when the printing just starts.

Comparative Example 1

Comparative Example 1 was performed almost in the same manner and under the same conditions as those in Example 1 except that the mixture for forming the electrically conductive elastomer layer includes 100 parts by weight of EPDM (trade name: EPDM 4070; manufactured by Mitsui Chemistry Co., Ltd), 70 parts by weight of carbon black (HAF), 5 parts by weight of zinc oxide, 1 part by weight of stearic acid, 55 parts by weight of paraffin oil, 40 parts by weight of calcium carbonate, 1 part by weight of sulfur, 2 parts by weight of a vulcanization accelerator M (mercapto benzothiazol), 1 part by weight of BZ (di-n-butyl dithio carbonate zinc), 1 part by weight of TT, thereby obtaining a desired transfer roller in the same manner as that in Example 1.

Then, a measuring device shown in FIG. 4 was used to measure the electric resistance of the elastic roller under conditions where an aluminium drum is rotated to drive the elastic roller, and it was found that after the roller had been placed for 24 hours in an environment of N/N and when the direct current voltage is 2 kV, the electric resistance is $1.2\times10^8$–$2.6\times10^8$ Ω (non-uniform resistance distribution: max./min.=2.2), a hardness is 75° asker.

When the transfer roller was evaluated in the same manner as in Example 1, it was found that durability and other properties are just the same as those in Example 1.

When the above transfer roller was used to print a line drawing, a full black picture, or a half tone picture on a dried paper in an environment of L/L, pictures with partially blurred characters were obtained.

Further, when the above transfer roller was used to print a picture on either side of a dried paper in an environment of L/L, it was found that the picture on the second side was grainy.

Comparative Example 2

Comparative Example 2 was performed almost in the same manner and under the same conditions as those in Example 1 except that, the mixture for forming the electrically conductive elastomer layer includes 50 parts by weight of epichlorohydrin rubber (trade name: EPICHLONER-H, manufactured by DAISO Co., Ltd.), 50 parts by weight of BR (trade name: BR-01, manufactured by JAPAN Synthetic Rubber Co., Ltd.), 5 parts by weight of zinc oxide, 1 part by weight of stearic acid, 30 parts by weight of calcium carbonate, 20 parts by weight of liquid NBR, 5 parts by weight of MgO, 1 part by weight of ethylene thiourea, thereby obtaining a desired transfer roller in the same manner as that in Example 1.

Then, a measuring device shown in FIG. 4 was used to measure the electric resistance of the elastic roller under conditions where an aluminium drum is rotated to drive the elastic roller, and it was found that after the roller had been placed for 24 hours in an environment of N/N and when the direct current voltage is 2 kV, the electric resistance is $3.0\times10^8$–$3.2\times10^8$ Ω (non-uniform resistance distribution: max./min.=1.07), and the hardness is 68° asker.

When the transfer roller was evaluated in the same manner as that in Example 1, it was found that the picture quality and durability are just the same as those in Example 1.

Then, in an environment of 40° C. and 95% R. H., when the transfer roller had been pressed against an organic photosensitive body with a total force of 1 kg for 2 weeks, it was found that the transfer roller was stuck on the photosensitive body.

Further, with the use of an ultraviolet ray irradiation device, the transfer roller was irradiated by ultraviolet rays under conditions of 40 mW/cm$^2$ with the irradiating time being 4 minutes. Then, in an environment of 40° C. and 95% R. H., the transfer roller was pressed against an organic photosensitive body with a total force of 1 kg for 30 days, and it was found that the transfer roller was stuck on the photosensitive body. When such a photosensitive body was used to print a full black picture in an environment of N/N, it was found that there were some white contact traces.

EXAMPLE 8

Comparative Example 3 was performed almost in the same manner and under the same conditions as those in Example 1 except that the mixture for forming the electrically conductive elastomer layer includes 50 parts by weight of NBR (trade name: N215SL; nitryl component: 48 wt %; manufactured by JAPAN Synthetic Rubber Co., Ltd.), 30 parts by weight of EPDM (trade name: ETP4070; iodine value: 22; manufactured by Mitsui Chemistry Co., Ltd.), thereby obtaining a desired transfer roller in the same manner as that in Example 1.

Then, a measuring device shown in FIG. 4 was used to measure the electric resistance of the elastic roller under conditions where an aluminium drum is rotated to drive the elastic roller, and it was found that after the roller had been placed for 24 hours in an environment of N/N and when the direct current voltage is 2 kV, the electric resistance is $1.2\times10^8$–$1.6\times10^8$ Ω (non-uniform resistance distribution: max./min.=1.03), and the hardness is 70° asker.

When the transfer roller was evaluated in the same manner as that in Example 1, it was found that the picture quality, durability and contact pressing property are just the same as those in Example 1.

Further, with the use of an ultraviolet ray irradiation device, the transfer roller was irradiated by ultraviolet rays under conditions of 40 mW/cm$^2$ with the irradiating time being 4 minutes. Then, in an environment of 40° C. and 95% R. H., the transfer roller was pressed against an organic photosensitive body with a total force of 1 kg for 30 days, and it was found that the transfer roller did not stick to the photosensitive body. However, when such a photosensitive body was used to print a full black picture in an environment of N/N, it was found that there were some white contact traces.

Comparative Example 3

Comparative Example 4 was performed almost in the same manner and under the same conditions as those in Example 1 except that, the mixture for forming the electrically conductive elastomer layer includes 20 parts by weight of ethylenic plasticizer (trade name: W-305 ELS; manufactured by Dainihon Ink Industry Co., Ltd.) which was used to replace the NBR, thereby obtaining a desired transfer roller in the same manner as that in Example 1.

Then, a measuring device shown in FIG. 4 was used to measure the electric resistance of the elastic roller under conditions where an aluminium drum is rotated to drive the elastic roller, and it was found that after the roller had been placed for 24 hours in an environment of N/N and when the direct current voltage is 2 kV, the electric resistance is $5.3\times10^8$–$5.8\times10^8$ Ω (non-uniform resistance distribution: max./min.=1.09), and the hardness is 65° asker.

When the transfer roller was evaluated in the same manner as that in Example 1, it was found that picture quality, and durability are just the same as those in Example 1.

Then, in an environment of 40° C. and 95% R. H., when the transfer roller had been pressed against the photosensitive body with a total force of 1 kg for 2 weeks, it was found that the transfer roller did not stick to the photosensitive body, but the plasticizer had migrated.

Further, with the use of an ultraviolet ray irradiation device, the transfer roller was irradiated by ultraviolet rays under conditions of 40 mW/cm$^2$ with the irradiating time being 4 minutes. Then, in an environment of 40° C. and 95% R. H., the transfer roller was pressed against an organic photosensitive body with a total force of 1 kg for 30 days, and it was found that the transfer roller did not stick on the photosensitive body, but the plasticizer had migrated to the surface of the photosensitive body. Moreover, when such a photosensitive body was used to print a full black picture in an environment of N/N, it was found that there had occurred some white contact traces and that toner had stuck to the surface of the photosensitive body along the white traces on which the transfer roller had got in contact with the photosensitive body.

EXAMPLE 9

A transfer roller includes a metal core member 31 having a diameter of 6 mm and a semiconductive elastomer layer 32. The metal core member is electrically conductive and may be made of stainless steel, iron without any coating, or iron coated with nickel or nickel/chrome in order to effect rust-proofing.

A mixture for forming the semiconductive elastomer layer includes 40 parts by weight of epichlorohydrin rubber (trade name: EPICHLONER-H, epichlorohydrin 10%, manufactured by DAISO Co., Ltd.), 40 parts by weight of NBR (trade name: N240S; nitryl component: 26 wt %; manufactured by JAPAN Synthetic Rubber Co., Ltd.), 20 parts by weight of EPDM (trade name: EPT4070; iodine value: 22; manufactured by Mitsui Chemistry Co., Ltd.), 3 parts by weight of hydrotalcite ($Mg_{4.3}Al_2(OH)_{12.6}CO_3.mH_2$), 3 parts by weight of zinc oxide, 2 parts by weight of stearic acid, 40 parts by weight of calcium carbonate, 20 parts by weight of liquid NBR, 0.5 parts by weight of sulfur, 1.2 parts by weight of 6-methylquinoxaline-2,3-dithio carbonate, 2 parts by weight of a vulcanization accelerator DM and, 1.5 parts by weight of dipentamethylene thiuram tetrasulfide (TRA).

At first, a mixture having the above composition was formed into a rubber tube by extrusion molding, followed by vulcanization at a temperature of 160° C. for 30 minutes. Then, the rubber tube was further vulcanized at a temperature of 150° C. for 30 minutes so as to obtain a vulcanized rubber product. The rubber tube was then forced over the above metal core member coated with an adhesive. Subsequently, the surface of the rubber tube was abraded, thereby obtaining an elastic roller having a diameter of 16 mm.

Then, a measuring device shown in FIG. 4 was used to measure the electric resistance of the elastic roller under a condition where an aluminium drum is rotated to drive the elastic roller, and it was found that after the roller had been placed for 24 hours in an environment of N/N and when the direct current voltage is 2 kV, the electric resistance is $1.39\times10^8$–$1.49\times10^8$ Ω (non-uniform resistance distribution: max./min.=1.07), and the hardness is 61° asker.

Further, the reactivity was measured and it was found that there was not any change in the measurement value ((max. torque−min. torque) * 50% time/160° C.)) before and after extrusion molding.

Then, the above roller was used as the transfer roller in the electrophotograph apparatus shown in FIG. 1, and the test result was evaluated.

Process speed is 100 mm/sec. The diameter of the photosensitive body is 300 mm. The photosensitive drum is electrified to bear negative charges, toner is electrified to bear positive charges, the electric voltage applied to the transfer roller is −3 kV (during transfer), but such voltage is 1.5 kV (during cleaning).

When the above transfer roller was used to print a line drawing, a full black picture, or a half tone picture on a dried paper in an environment of L/L (10° C., 15% R.H.)–(32.5° C., 80% R.H.), the pictures obtained are all clear and distinct.

Further, when the above transfer roller was used to print a picture on either side of a dried paper in an environment of L/L, it was found that effects similar to the above could be obtained.

Moreover, when the above transfer roller was used to continuously print pictures on 200,000 pieces of paper, it was found that no defective pictures was occurred due to a change in resistance, and that there was no any problem in picture quality due to a change in the outer diameter of the transfer roller.

In addition, when the same transfer roller is caused to press against the organic photosensitive body with a total force of 1 kg under conditions of 40° C., 95% R.H. for two weeks, it was found that no trouble such as sticking occurred.

Further, the transfer roller was treated with the use of an ultraviolet ray irradiation device (using wave lengths of 185 nm and 245 nm as main components) under conditions of 40 mW/cm$^2$ for 4 minutes. Then, the transfer roller was forced to press against the organic photosensitive body with a total force of 1 kg in an environment of 40° C., 95% R.H. for 30 days, it was found that no trouble such as sticking occurred.

When the photosensitive body was used to print pictures in an environment of N/N, printed pictures of good quality were obtained without any trace (indicating the fact of having been pressed) remaining thereon.

EXAMPLE 10

Example 10 was performed almost in the same manner and under the same conditions as those in Example 9 except that 3 parts by weight of MgO was used as an acid neutralizing agent, and 1.2 parts by weight of ethylene thiourea was used as a vulcanizing agent, thereby obtaining a desired transfer roller in the same manner as that in Example 9. As physical properties of the transfer roller, it was found that the electric resistance in the same lot is $1.87\times10^8$–$2.95\times10^8$ Ω (non-uniform resistance distribution: max./min.=1.57), and the hardness is 60° asker with the other evaluation results being the same as those in Example 9.

Further, the reactivity was measured and it was found that the measurement value ((max. torque−min. torque) * 50% time/160° C.)) before and after extrusion molding had increased to an extent of 2.8 times. Namely, as compared with Example 8, the physical properties had changed (due to processing conditions) to a greater extent than in Example 8.

EXAMPLE 11

Example 11 was performed almost in the same manner and under the same conditions as those in Example 9 except that 3 parts by weight of hydrotalcite was used as an acid neutralizing agent, 1.5 parts by weight of 2,4,6-trimercapto-S-triazine was used as a vulcanizing agent, thereby obtaining a desired transfer roller in the same manner as that in Example 9. As physical properties of the transfer roller, it was found that the electric resistance in the same lot is $2.66\times10^8$–$2.88\times10^8$ Ω (non-uniform resistance distribution: max./min.=1.08), and the hardness is 63° asker with the other evaluation results being the same as those in Example 9.

Further, the reactivity was measured and it was found that there was not any change in the measurement value ((max. torque−min. torque) * 50%time/160° C.)) before and after extrusion molding.

EXAMPLE 12

Example 11 was performed almost in the same manner and under the same conditions as those in Example 9 except that 8 parts by weight of oxibisbenzene sulfonyl hydrazine was used as a foaming agent, and a secondary vulcanization was conducted at a temperature of 160° C. for 30 minutes, thereby obtaining a desired transfer roller in the same manner as that in Example 9. As physical properties of the transfer roller, it was found that the electric resistance in the same lot is $3.5\times10^8\times3.8$–$10^8$ Ω (non-uniform resistance distribution: max./min.=1.09), and the hardness is 35° asker, with the other evaluation results being the same as those in Example 8.

Further, the reactivity was measured and it was found that there was not any change in the measurement value ((max. torque−min. torque) * 50%time/160° C.)) before and after extrusion molding.

EXAMPLE 13

Example 13 was performed almost in the same manner and under the same conditions as those in Example 12 except that, 5 parts by weight of zia neutralizing agent a neutralizing agent, and 2 parts by weight of ethylene thiourea was used as a vulcanizing agent, thereby obtaining a desired transfer roller in the same manner as that in Example 12. As physical properties of the transfer roller, it was found that the electric resistance in the same lot is $5.1\times10^8$–$5.6\times10^8$ Ω (non-uniform resistance distribution: max./min.=1.1), and the hardness is 33° asker.

Moreover, when the above transfer roller was used to continuously print pictures on 200,000 pieces of paper, it was found that no defective pictures occurred due to change in resistance, but it was found that there was a significant change in the outer diameter of the transferring roller and that the paper transporting force had fluctuated, resulting in some non-printed portions in characters or pictures.

Other evaluation results were just the same as those in Example 9.

Further, the reactivity was measured and it was found that there was not any change in the measurement value ((max. torque−min. torque) * 50% time/160° C.)) before and after extrusion molding.

What is claimed is:

1. An electrifying member that has an electric voltage applied to it in order to electrify a surface of another member, said electrifying member comprising:

an electrically conductive elastomer obtained by vulcanizing a mixture comprising a non-liquid nitrile rubber, a liquid nitrile rubber, and a non-polar polymer, wherein the liquid nitrile rubber is in a liquid state in the electrically conductive elastomer.

2. The electrifying member according to claim 1, wherein said mixture further comprises an epichlorohydrin rubber.

3. The electrifying member according to claim 2, wherein said mixture further comprises a hydrotalcite.

4. The electrifying member according to claim 3, wherein said mixture further comprises 6-methylquinoxaline-2,3-dithiocarbonate.

5. The electrifying member according to claim 1, wherein said electrically conductive elastomer comprises 25–90 wt % of non-liquid nitrile rubber, and 10–75 wt % of non-polar polymer.

6. The electrifying member according to claim 1, wherein said non-liquid nitrile rubber contains a nitrile at an amount of 15–40 wt %.

7. The electrifying member according to claim 1, wherein said non-polar polymer is EPDM.

8. An electrifying member that has an electric voltage applied to it in order to electrify a surface of another member, said electrifying member comprising:

an electrically conductive elastomer obtained by vulcanizing a mixture comprising an epichlorohydrin rubber;

wherein a vulcanized product obtained by the above vulcanizing process contains a hydrotalcite.

9. The electrifying member according to claim 8, wherein said mixture further comprises 6-methylquinoxaline-2,3-dithiocarbonate.

10. The electrifying member according to claim 8, wherein said mixture further comprises a nitrile rubber.

11. The electrifying member according to claim 8, wherein said mixture further comprises a non-polar polymer.

12. The electrifying member according to claim 11, wherein said non-polar polymer is EPDM.

13. The electrifying member according to claim 12, wherein a surface of the electrifying member has been irradiated by ultraviolet radiation.

14. A process cartridge comprising an electrifying member and a photosensitive body, both of which are integrally formed into a cartridge detachably mountable on a main body of an electrophotograph apparatus, wherein said electrifying member is made in accordance with any one of claims 1–13.

15. The process cartridge according to claim 14, wherein said electrifying member is a transfer roller.

16. An electrophotograph apparatus having an electrifying member and a photosensitive body, wherein said electrifying member is made in accordance with any one of claims 1–13.

17. The electrophotograph apparatus according to claim 16, wherein the electrifying member is a transfer roller.

* * * * *

UNITED STATES PATENT AND TRADEMARK OFFICE

CERTIFICATE OF CORRECTION

PATENT NO. : 6,078,778
DATED : June 20, 2000
INVENTOR(S) : Jun Murata, et al.

It is certified that error appears in the above-identified patent and that said Letters Patent is hereby corrected as shown below:

Title page,
Item [57], Abstract
Line 2, "capable of" should be deleted.

Column 1,
Line 46, "maybe" should read -- may be --.

Column 5,
Line 66, "press" should read -- process --.

Column 10,
Line 26, "of electric" should read -- of an electric --.

Column 11,
Line 3, "tetrathiuram" should read -- tetra thiuram --.
Line 49, "condition" should read -- conditions --.

Column 12,
Line 26, "Sythetic" should read -- Synthetic --.
Line 58, "a" should be deleted.

Column 13,
Line 13, "a" should be deleted.
Line 37, "a" should be deleted.

Column 14,
Line 32, "a" should read -- and the --.

Column 15,
Line 59, "Comparative Example 4" should read -- Comparative Example 3 --.

Column 16,
Line 48, "$Mg_{4.3}Al_2$ (OH) $_{12.6}CO_3.mH_2$)" should read -- $Mg_{4.3}Al_2$ (OH) $_{12.6}CO_3 \bullet mH_2O$) --.
Line 53, "DM and," should read -- DM, and --.

UNITED STATES PATENT AND TRADEMARK OFFICE

CERTIFICATE OF CORRECTION

PATENT NO. : 6,078,778
DATED : June 20, 2000
INVENTOR(S) : Jun Murata, et al.

It is certified that error appears in the above-identified patent and that said Letters Patent is hereby corrected as shown below:

Column 17,
Line 30, "was" should be deleted.
Line 31, "any" should be deleted.

Column 18,
Line 27, "Example 11" should read -- Example 12 --.
Line 48, "zia neutralizing agent a" should read -- zinc oxide was used as a -- .

Signed and Sealed this

Twenty-third Day of October, 2001

*Attest:*

Nicholas P. Godici

*Attesting Officer*

NICHOLAS P. GODICI
*Acting Director of the United States Patent and Trademark Office*